United States Patent [19]

Eskesen

[11] 4,134,709

[45] Jan. 16, 1979

[54] THERMOSYPHON LIQUID COOLED TURBINE BUCKET

[75] Inventor: John H. Eskesen, Schenectady, N.Y.

[73] Assignee: General Electric Company, Schenectady, N.Y.

[21] Appl. No.: 716,982

[22] Filed: Aug. 23, 1976

[51] Int. Cl.[2] ..... F01D 5/18

[52] U.S. Cl. ..... 416/1; 416/96 R

[58] Field of Search ..... 416/92, 95, 97; 415/115, 116

[56] References Cited

U.S. PATENT DOCUMENTS

| | | | |
|---|---|---|---|
| 2,667,326 | 1/1954 | Ledinegg | 416/96 |
| 2,778,601 | 1/1957 | Eckert | 416/96 |
| 2,779,565 | 1/1957 | Bruckmann | 416/96 A |
| 2,883,151 | 4/1959 | Dolida | 416/96 |
| 3,550,372 | 12/1970 | Craig | 416/95 |
| 3,619,076 | 11/1971 | Kydd | 416/96 X |
| 3,816,022 | 6/1974 | Day | 416/97 X |
| 3,902,819 | 9/1975 | Holchendler et al. | 416/96 X |

*Primary Examiner*—Everette A. Powell, Jr.

*Attorney, Agent, or Firm*—Richard G. Jackson; Joseph T. Cohen; Leo I. MaLossi

[57] ABSTRACT

A liquid cooled turbine bucket is provided with a plurality of generally radially extending subsurface coolant channels which are supplied with liquid coolant from a manifold in the bucket tip portion. Liquid coolant is delivered directly and solely to the bucket tip manifold via conduit means extending through the root and core portions of the bucket. The liquid coolant in the coolant channels removes heat from the turbine bucket by pool boiling, the resulting vapor being collected in vapor manifolds disposed radially inwardly from the channels and exhausted from the bucket.

13 Claims, 4 Drawing Figures

THERMOSYPHON LIQUID COOLED TURBINE BUCKET

BACKGROUND OF THE INVENTION

1. Field of the Invention

This invention relates generally to a liquid cooled turbine bucket and more specifically to such a turbine bucket cooled by a thermosyphon effect.

2. Description of the Prior Art

Ultrahigh temperature (UHT) gas turbines operate in a range from 2500° F. to 3500° F., with the objective of providing as much as 200 percent more power and achieving as much as 50 percent greater thermal efficiency than conventional gas turbines. Materials employed in the manufacture of such turbines and the operating conditions therefor dictate that the buckets thereof be provided with liquid cooling.

A suitable method for liquid cooling ultrahigh temperature gas turbine blades is that afforded by open circuit liquid cooled bucket constructions such as are shown in U.S. Pat. No. 3,816,022 to Day, assigned to the assignee of the present invention. In such an open circuit liquid cooled turbine bucket construction, water or any other suitable liquid coolant is sprayed onto the sides of a turbine disk on which the buckets to be cooled are mounted. Acting under the influence of centrifugal force due to the rotation of the disk, the coolant flows radially outward collecting in gutters provided in the rim portion of the disk. The coolant flows through radially extending passages provided in the gutters, these passages communicating with coolant passages provided in the bucket below the surface thereof through flow channels disposed in the bucket platform. Again acting under the centrifugal force exerted upon the rotating bucket, the coolant flows through the subsurface channels in the bucket absorbing heat transferred to the bucket from the high temperature working fluid of the gas turbine. As the coolant flows through the subsurface channels, it is partially vaporized. The liquid and vapor components of the fluid are discharged at the tip portion of the bucket, the liquid component of the coolant moving in the generally radially outward direction through the gap between the bucket and turbine casing into a collection slot disposed within the casing.

It has been found that the cooling of ultrahigh temperature turbine buckets as afforded by the open circuit bucket construction described can be improved upon in a number of respects. For example, certain portions of ultrahigh temperature turbine buckets are heated to higher temperatures than other portions and therefore may require a higher coolant flow therethrough than other cooler portions of the bucket. However, in an open circuit liquid cooled turbine bucket having radially extending coolant channels there is no way to accurately meter varying amounts of liquid coolant to particular channels according to the temperatures to be experienced by the portions of the bucket in which those channels are disposed. Therefore, relatively large quantities of coolant must be metered to all the coolant channels to assure that none will receive too little. This may cause excessive quantities of liquid coolant which never vaporize within the bucket to be discharged from the bucket. Any liquid coolant discharged from the open circuit turbine bucket and becoming entrained in the motive fluid stream may contribute to the erosion of latter bucket stages thereby decreasing the useful life and increasing the frequency of repair or replacement of those buckets.

It will also be appreciated that the coolant discharged from an open circuit liquid cooled turbine bucket as vapor also enters the motive fluid stream and is thereby unrecoverable for condensation and reuse as a coolant. Therefore, it is also desirable to recover as much vaporized coolant exiting the turbine bucket as possible.

Liquid cooling by open circuit bucket configurations may also lower the efficiency of the turbine from the theoretical value. When the coolant is sprayed onto the turbine disk supporting the open circuit liquid cooled buckets, the fluid is accelerated to the velocity of the turbine disk. As the disk and the buckets rotate under the influence of the working fluid, they must be provided the requisite power to rotate the mass of coolant within each of the buckets. When the coolant is discharged from the bucket tip, it is moving at a velocity equal to the tangential velocity of the bucket tip. The velocity at which the coolant is discharged from the bucket is representative of what are commonly referred to as pumping losses. These pumping losses represent lost work which the turbine wheel and buckets have done on the coolant and which, if not recovered in a manner such as that disclosed in the aforementioned patent to Day are unavailable for any useful function. Therefore, to the extent they are not recovered, these pumping losses represent a diminished efficiency and decreased power output capability of the turbine.

Although thermosyphon cooling of gas turbine buckets is taught in the prior art (Mixed Convection Thermosyphon and Gas Turbine Blade Cooling — David Japikse and Jacob Holchendler, ASME Paper 73 — WA/HT-26, 1973) coolant vaporized within such buckets is discharged from the trailing edge of the bucket into the main motive fluid stream and is therefore unavailable for collection and reuse. Furthermore, as set forth hereinafter, constructions employed in such prior art thermosyphon cooling arrangements differ from the construction and operation of the present invention and do not provide as effective cooling as the arrangement disclosed and claimed herein.

Accordingly, it is an object of the present invention to provide a thermosyphon liquid cooled turbine bucket which minimizes the consumption of liquid coolant.

It is another object of the present invention to provide a thermosyphon liquid cooled turbine bucket wherein losses associated with the pumping of liquid coolant through the bucket are minimized.

SUMMARY OF THE INVENTION

These and other objects apparent from the following detailed description taken in connection with the appended claims and accompanying drawings are attained by providing a thermosyphon liquid cooled turbine bucket with a plurality of generally radially extending subsurface coolant channels supplied with liquid coolant from a liquid manifold in the bucket tip portion. Liquid coolant is delivered directly and solely to the bucket tip manifold via conduit means extending through the root and core portions of the bucket. The liquid coolant in the subsurface coolant channels removes heat from the turbine bucket by pool boiling, the resulting vapor being collected in vapor manifolds disposed radially inwardly from the channels and exhausted from the bucket. This vaporized coolant may be discharged, radially inwardly from the bucket minmizing pumping losses and collected for condensation and reuse.

It will be understood that the term "tip portion" is intended to refer to the extremity of the bucket construction radially outward of the termination of the coolant channel(s) and will include shroud elements, when employed. It will be further understood that the term "manifold" as used herein indicates a chamber or other suitable structure for collecting or distributing a predominately single phase fluid flow. The terms "radially inner" and "radially outer" refer to positions on the bucket relative to a turbine wheel on which the bucket is adapted to be mounted. "Radially inner" refers to those positions closest to the central axis of the wheel. "Radially outer" refers to positions farther away from the central axis.

DESCRIPTION OF THE PREFERRED EMBODIMENT

Figure 1:
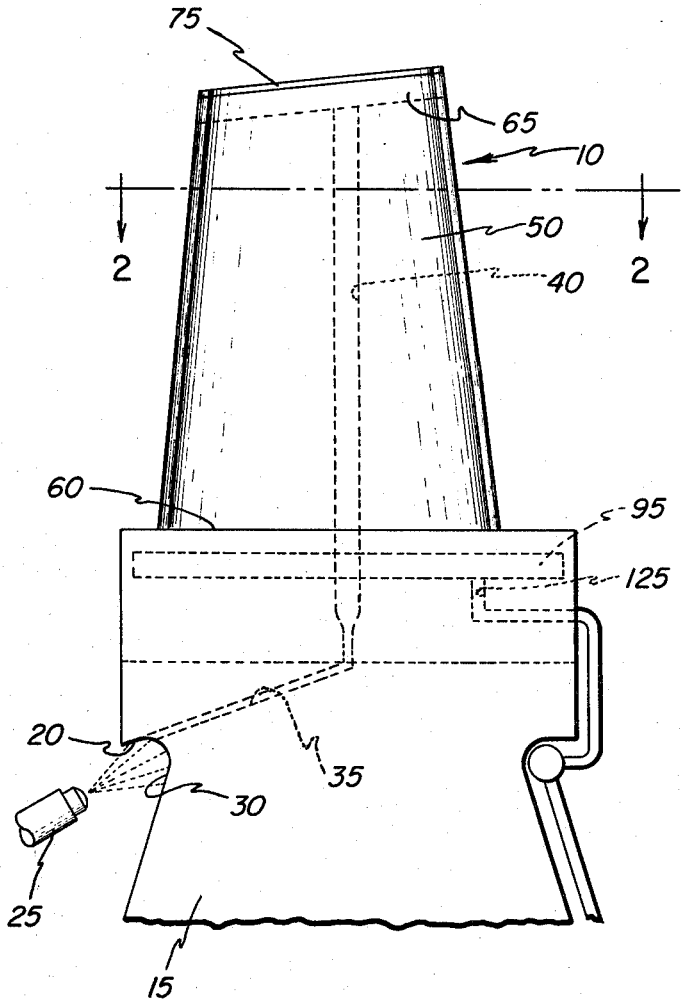
FIG. 1 is an elevated view of the thermosyphon liquid cooled turbine bucket of the present invention showing the bucket mounted on a turbine disk.

Referring to FIG. 1 there is shown the thermosyphon liquid cooled turbine bucket 10 of the present invention mounted on a turbine wheel or disk 15 having formed therein an angular gutter 20, which collects water or other suitable liquid coolant sprayed thereon by any number of sprayers, one of which is shown at 25. Although gutter 20 is shown as being formed integrally with disk 15 it will be understood that a gutter separate from and attachable to disk 15 may also be employed. The coolant sprayed from sprayer 25 impinges upon surface 30 of gutter 20 and is accelerated by the rotating disk to the velocity of the disk. Acting under the influence of centrifugal force, the coolant is forced outwardly through passage 35 in disk 15. Passage 35 communicates with a radially extending liquid coolant supply conduit 40 disposed within the interior of bucket 10. Supply conduit 40 may be either cast or drilled in bucket 10.

Figure 2:
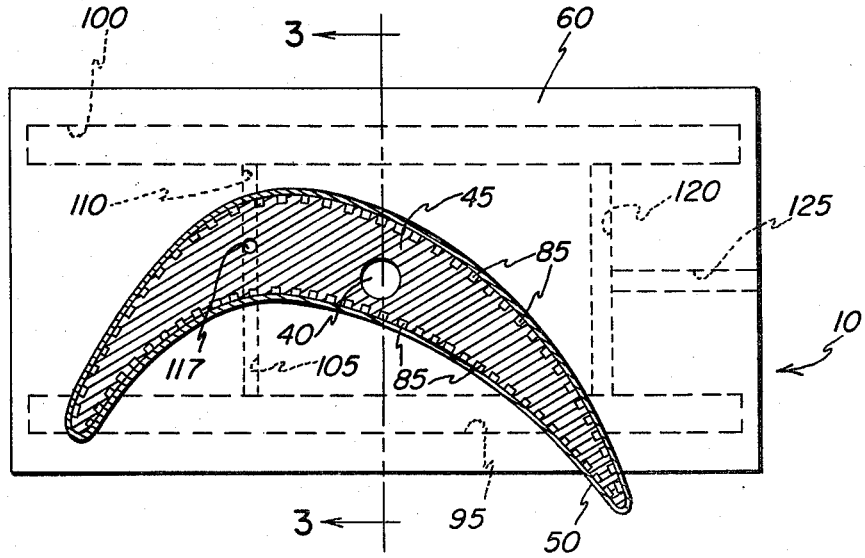
FIG. 2 is a sectional view taken along line 2—2 of FIG. 1.
Figure 3:
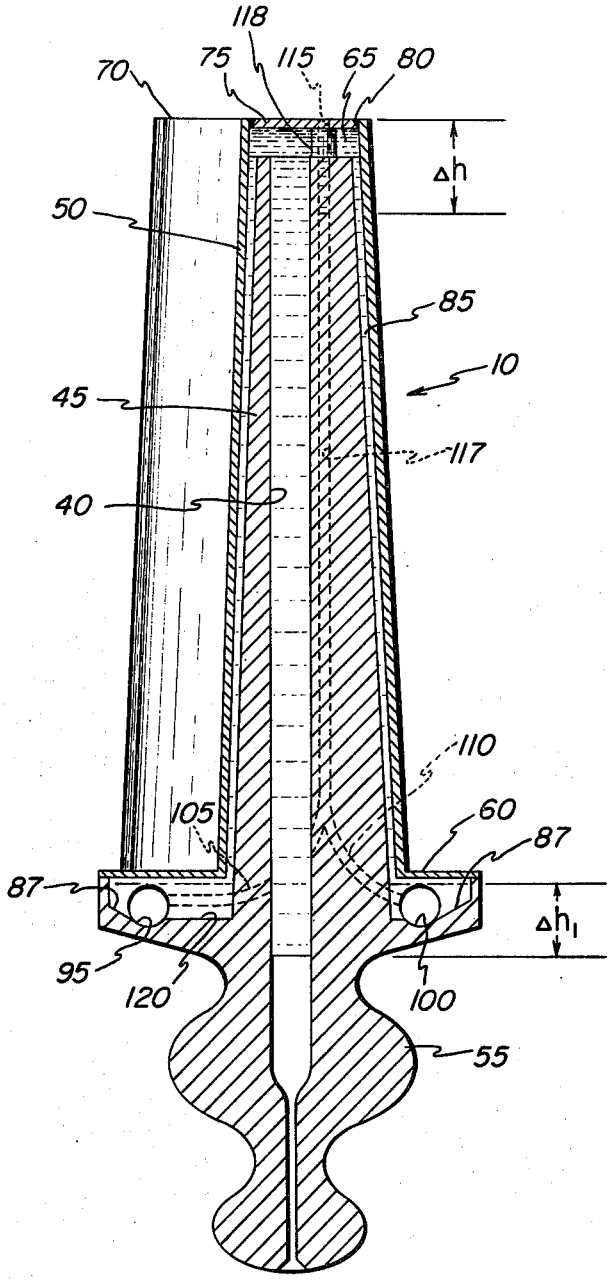
FIG. 3 is a sectional view taken along line 3—3 of FIG. 2.
Figure 4:
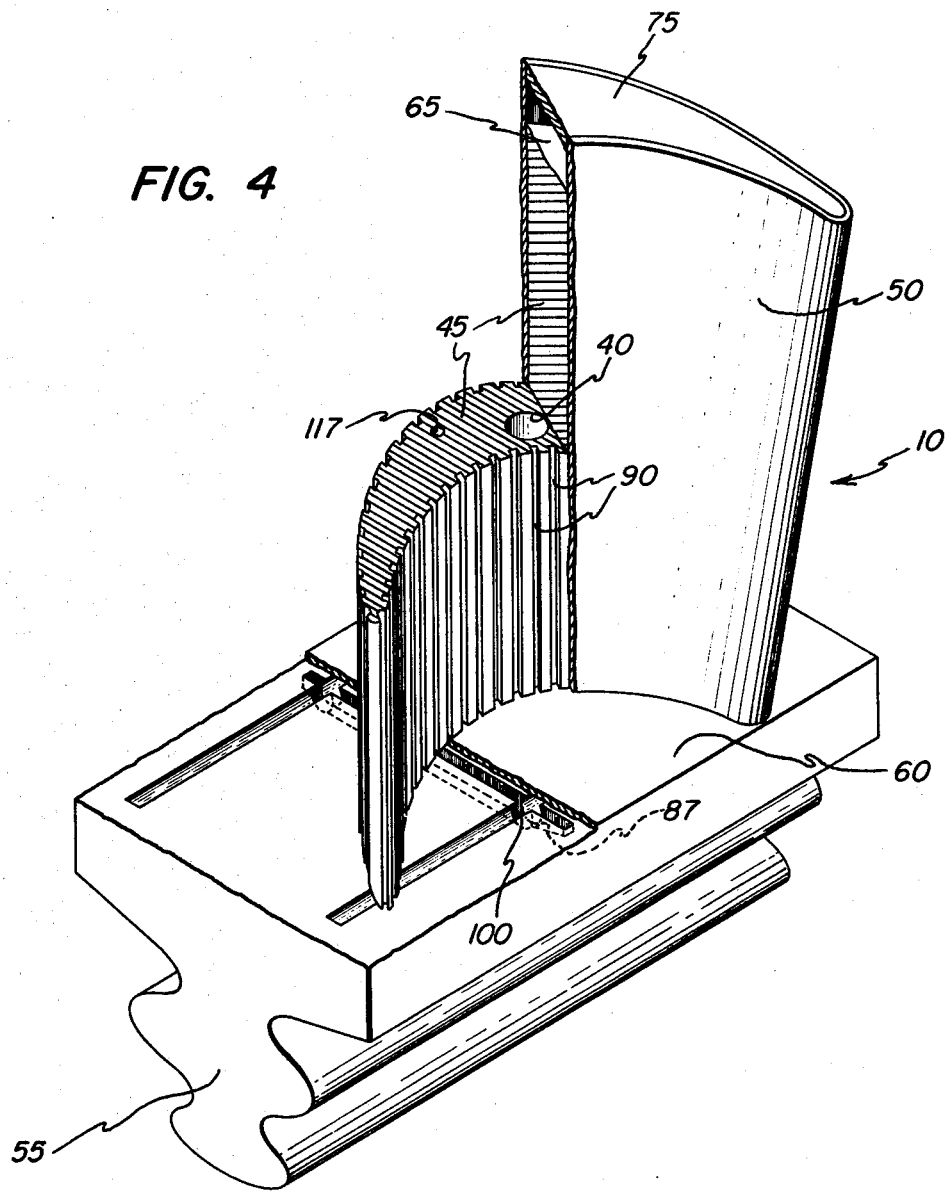
FIG. 4 is a three-dimensional view of the thermosyphon liquid cooled turbine bucket of the present invention partially broken away to show details of construction.

Referring to FIGS. 2, 3 and 4, bucket 10 comprises a core 45 and an overlying conforming skin 50, which presents an aerodynamic surface to the flow of working fluid impinging upon the bucket. Bucket 10 also includes a dovetail root portion 55 and a platform element 60. The dovetail root portion 55 forms no part of the present invention, and it will be understood that other suitable means for fixing bucket 10 to disk 15 may be employed. As shown, supply conduit 40 extends unbroken and uninterrupted through root 55 and core 45 from an opening in root 55 and communicates directly with and supplies liquid coolant only to a liquid manifold 65 disposed in the tip portion 70 of bucket 10. Manifold 65 is defined by core 45, skin 50 and a cap 75 fixed to skin 50 by brazing, welding, or other suitable methods at 80.

Manifold 65 feeds liquid coolant received from supply conduit 40 to a plurality of subsurface coolant channels 85 disposed on both suction and pressure sides of bucket 10 and defined by skin 50 and grooves 90 machined or cast in core 45. Coolant channels 85 each include an enlarged end portion 87 disposed beneath platform element 60 to cool the platform. As hereinafter described, coolant channels 85 remain filled with liquid coolant during the operation of the turbine thereby providing better heat absorption from skin 50 that could be provided with prior art open circuit liquid cooling schemes wherein the subsurface channels are filled with a mixture of liquid and vaporized coolant.

Moreover, since channels 85 remain filled with liquid coolant throughout the operation of the turbine, these channels may be formed with a larger cross sectional area than the subsurface coolant channels employed with open circuit liquid cooled turbine buckets. Due to Coriolis forces, in an open circuit liquid cooled turbine bucket, the liquid coolant is conducted through the subsurface coolant channels as a film in contact with usually only one side of the channel. Therefore, to provide the necessary area of contact between the liquid coolant film and the bucket itself to effect the required cooling, the channels are required to be many in number and spaced relatively close together. This coolant channel geometry makes the machining of these coolant channels time consuming and costly. The larger cross sectional area of the coolant channels employed in the present invention allows the channels to be provided in fewer numbers thereby eliminating much of the expense in machining.

Heat which is absorbed by the liquid coolant in channels 85 from skin 50 and platform element 60 causes the liquid coolant to boil. Such pool boiling, the generation of vapor bubbles in a body of liquid due to heat input to the liquid, provides a very effective means of transferring heat from the bucket skin to the coolant and is aided by the centrifugal effects of the rotation of the bucket as hereinafter described. As the coolant boils within channels 85, the vapor bubbles rapidly accelerate radially inwardly and are collected in one or more collection zones. Two such zones are defined by vapor manifolds 95 and 100 disposed radially inwardly from coolant channels 85 on both pressure and suction sides respectively of bucket 10. The rapid acceleration of the vapor bubbles resulting from the boiling is due to the extreme differences in density between the vapor and the liquid coolant making the vapor bubbles very buoyant within the liquid. Additionally, the centrifugal force of rotation acts upon both the liquid and vapor components of the coolant, and, in the manner of a centrifugal separator, forces the liquid component radially outward relative to the vapor component thereby enhancing the radially inward movement of the vapor bubbles toward the vapor manifolds.

The liquid coolant level within coolant channels 85 of the thermosyphon liquid cooled turbine bucket of the present invention is self-adjusting ensuring that the heat transfer from the bucket skin will be to a liquid rather than to a vapor, thus maintaining pool boiling within each of channels 85. Liquid coolant is provided from sprayer 25 to the thermosyphon bucket at the desired rate. If the liquid coolant level in one or more channels is reduced to a position radially outward from vapor manifolds 95 and 100, the boiling rate within such channels will decrease due to the decreased area of contact between the channel walls and the liquid within the channels. The decreased boiling rate allows more coolant to enter these channels than exits the channels by boiling, thereby causing the channels to re-fill with liquid coolant to a level adjacent vapor manifolds 95 and 100. Once the liquid level is returned to that region, boiling will increase in rate due to the increased area of contact between the liquid coolant and the channel walls thereby preventing excessive amounts of liquid coolant from overflowing to the vapor manifold with which the channels communicate. However, there is always a risk that a slight overflow of liquid coolant from the channels radially inward into the vapor manifolds may exist. Therefore, first and second drain passages 105 and 110 communicating with vapor manifolds 95 and 100 respectively are provided and communicate through third drain passage 117 with a drain orifice 115 disposed within cap 75. Drain passage 117 includes a tube 118 isolating any drain flow from manifold 65. Tube 118 may be formed integrally with core 45 or fixed to core 45 and cap 75 by brazing or other suitable methods. In the preferred embodiment, drain passages 105, 110 and 117 are cast into core 45. However, other techniques such as drilling may be employed. Orifice 115 is sized to allow a small head $\Delta h$ of liquid coolant to develop thereunder, preventing any steam leaks from the orifice. A slight discharge of liquid coolant from orifice 115 indicates that channels 85 are filled with liquid coolant and therefore that heat is being effectively transferred from skin 50 by pool boiling.

To equalize the vapor pressure within manifolds 95 and 100, these manifolds are placed in communication with each other through a pressure equalizing vapor conduit 120. Any vapor pressure buildup within manifolds 95 and 100 and will be accommodated by a head $\Delta h_1$ of liquid coolant within supply conduit 40 thereby preventing the exhaust of vaporized coolant into the motive fluid stream through drain passage 117.

To provide for the exhaust of vaporized coolant from bucket 10, an exhaust passage 125 is provided in communication with pressure equalizing vapor conduit 120 and extends through dovetail portion 55 to the exterior of the bucket. The vaporized coolant may then be piped to a hollow shaft (not shown) disposed along the axis of rotation of the turbine disk. The vaporized coolant may then be collected for subsequent use as a vapor or may be condensed and reused for coolant. The exhaust of vaporized coolant at the root of the bucket minimizes the tangential velocity of the coolant so exhausted since, at the bucket root, the tangential velocity of the bucket is at a minimum. Therefore, the vaporized coolant is discharged at a minimal dynamic energy state thereby reducing the pumping losses associated with the bucket construction of the present invention over those associated with construction providing for the discharge of coolant at the bucket tip.

Although thermosyphon cooling of gas turbine buckets is taught in the prior art (Mixed Convection Thermosyphon and Gas Turbine Blade Cooling — David Japikse and Jacob Holchendler, previously cited) such buckets employ mixed convection rather than pool boiling as the mechanism for cooling the turbine buckets, and discharge the heated vapor to the working fluid downstream from the bucket rather that piping the vaporized coolant away from the bucket and turbine disk for the conservation of the fluid. Pool boiling provides a more effective means of cooling such a turbine bucket than a mixed convection scheme of heat transfer. The discharge of vaporized coolant into the working fluid stream prevents the collection and reuse of the vaporized coolant. Moreover, such buckets employ separate headers at the bucket tip portion rather than a single manifold and therefore do not achieve the ease of construction associated with the thermosyphon liquid cooled turbine bucket of the present invention. Furthermore, vapor within the coolant passages of such prior art buckets recirculates and mixes with supply coolant conducted from the blade root to the blade tip rather than remaining isolated from the liquid supply coolant as is the case in the thermosyphon liquid cooled turbine bucket of the present invention.

It should be noted that as an option the vaporized coolant collected in manifolds 95 and 100 may be discharged radially outwardly through the bucket tip portion 70, should this be desirable. In such an arrangement, it would of course be unnecessary to provide the bucket with conduit 120 and passage 125. Such an arrangement for exhausting vaporized coolant from the bucket would have no adverse effects upon the remainder of the thermosyphon liquid cooling arrangement of the present invention.

While the bucket construction of the present invention has been shown with no shroud, it will be appreciated that this construction may be effectively employed in a shrouded turbine bucket. In such a design, coolant channels such as those shown at 85 may be extended into the shroud, which itself may be provided with a manifold similar to manifold 65 illustrated in FIGS. 1, 3 and 4. In this design, coolant would be fed to such a manifold located in the shroud from a radially extending supply conduit directly connected thereto such as that shown at 40. The coolant channels would then be filled with coolant from this manifold as set forth hereinabove. A vented drain passage such as that shown at 117 may also be provided in the shroud element.

Therefore, it can be seen that the thermosyphon liquid cooled turbine bucket of the present invention may be cooled without the discharge of substantial quantities of coolant into the motive fluid stream and, therefore, without the waste of the coolant and the erosion of successive turbine bucket stages by coolant still in the liquid state. Since the vaporized coolant can be discharged from the bucket radially inward, the pumping losses associated with the turbine bucket of the present invention are minimized.

While there has been shown and described a specific embodiment of the thermosyphon liquid cooled turbine bucket of the present invention, it will be apparent to those skilled in the art that modifications may be made without departing from the substance of this invention and it is intended by the appended claims to cover such modifications as come within the spirit and scope of this invention.

What is claimed is:

1. In a thermosyphon liquid cooled turbine bucket comprising a core; a skin overlying said core and presenting an aerodynamic surface; a plurality of subsurface coolant channels disposed beneath said skin and having radially inner and radially outer ends, said subsurface coolant channels being disposed on both suction and pressure sides of said bucket and extending substantially the radial length of said aerodynamic surface; a tip portion disposed radially outward from the termination of said subsurface coolant channels; a root portion for fixing said bucket to a turbine disk; a platform disposed between said root portion and said core; means disposed in said tip portion for distributing liquid coolant to said subsurface coolant channels; means for receiving liquid coolant into said bucket and conducting liquid coolant to said distributing means; means in flow communication with the radially inner ends of said subsurface coolant channels for collecting vaporized coolant and means in flow communication with said collecting means for exhausting vaporized coolant from said bucket, the improvement comprising:

said receiving and conducting means being a liquid coolant supply conduit extending uninterrupted and unbroken from an opening in said root portion, through said root portion and said core, directly interconnecting said opening and said distributing means and said collecting means being in communication with said supply conduit only at said tip region via said subsurface coolant channels and said distributing means, said collecting means comprising:

(a) a first vapor manifold disposed between said root portion and said core, said first vapor manifold communicating with the radially inner ends of said subsurface coolant channels on the pressure side of said turbine bucket and (b) a second vapor manifold disposed between said root portion and said core, said second vapor manifold communicating with the radially inner ends of said subsurface coolant channels on the suction side of said turbine bucket, and a drain passage communicating with said first and second vapor manifolds and terminating in an outlet in said tip region, said drain passage providing for the discharge of excess liquid coolant from said first and second manifolds to the exterior of said bucket adjacent said tip portion.

2. The liquid cooled turbine bucket of claim 1 wherein said distributing means comprises a single manifold connected to all of the radially outer ends of said subsurface coolant channels.

3. The liquid cooled turbine bucket of claim 1 wherein said subsurface coolant channels are defined in part by said skin.

4. The liquid cooled turbine bucket of claim 1 wherein the radially inner ends of each of said subsurface coolant channels are disposed within said platform whereby coolant within said radially inner ends serves to cool said platform.

5. The liquid cooled turbine bucket of claim 1 wherein said vapor manifolds are interconnected by a pressure equalizing vapor conduit.

6. The liquid cooled turbine bucket of claim 5 wherein said means for exhausting vaporized coolant from said bucket comprises an exhaust passage communicating with said first and second vapor manifolds and extending to the exterior of said bucket.

7. The liquid cooled turbine bucket of claim 6 wherein said exhaust passage extends partially through said root portion to the exterior of said bucket adjacent said root portion.

8. The liquid cooled turbine bucket of claim 6 wherein said exhaust passage communicates with said first and second vapor manifolds through said pressure equalizing vapor conduit.

9. A liquid cooled turbine bucket comprising:

a root portion for fixing said bucket to a turbine wheel;

a core disposed radially outwardly from said root portion;

a tip portion disposed radially outwardly from said core;

a skin overlying said core and presenting an aerodynamic surface;

a network of subsurface coolant channels partially defined by and disposed beneath said skin on both suction and pressure sides of said turbine bucket said subsurface coolant channels having radially inner and outer ends;

a single liquid manifold disposed at the tip portion of said bucket, said liquid manifold communicating with said subsurface coolant channels at the radially outer ends thereof;

a liquid coolant supply conduit extending uninterrupted and unbroken from an opening in said root portion, through said core and communicating with said liquid manifold;

a first vapor manifold communicating with the radially inner ends of said subsurface coolant channels disposed on the pressure side of said turbine bucket;

a second vapor manifold communicating with the radially inner ends of said subsurface coolant channels disposed on the suction side of said turbine bucket;

said first and second vapor manifolds being blocked from communication with said supply conduit at all locations other than said tip portion, said first and second vapor manifolds communicating with said supply conduit at said tip region through said subsurface coolant channels and said liquid manifold;

a pressure equalizing vapor conduit interconnecting said first and second vapor manifolds;

a drain passage providing communication between said first and second vapor manifolds and the exterior of said bucket for discharging excess liquid coolant; and an exhaust passage providing communication between said first and second vapor manifolds and the exterior of said turbine bucket.

10. The liquid cooled turbine bucket of claim 9 wherein said drain passage communicates with the exterior of said turbine bucket through said tip portion.

11. The liquid cooled turbine bucket of claim 9 wherein said exhaust passage communicates with the exterior of said turbine bucket adjacent said root portion.

12. A method of detectable pool-boil cooling a turbine bucket heated during normal operation by a working fluid impinging on the bucket, said method comprising the steps of:

(A) continuously introducing a liquid coolant to the tip portion of said bucket;

(B) continuously distributing the introduced liquid coolant to a plurality of subsurface coolant channels from said tip portion;

said introducing step being carried out at a mass rate slightly greater than the mass rate sufficient to maintain said channels filled with a body of the distributed liquid coolant during vaporization cooling resulting from pool boiling of the liquid coolant in said channels at said sufficient mass rate;

(C) pool boiling by continuously transferred heat from the working fluid to the body of liquid coolant filling said channels at a heat transfer rate such that coolant vapor bubbles are generated at said sufficient mass rate in the coolant body by the heat input thereto;

(D) continuously collecting in a collection zone excess liquid coolant and vaporized coolant resulting from said pool boiling, said collection zone being disposed radially inwardly from said subsurface coolant channels;

(E) continuously removing said vaporized coolant from said collection zone; and (F) continuously discharging said excess liquid coolant radially outwardly from said collection zone along a drainage path extending therefrom to the exterior of said bucket adjacent said tip portion such that the liquid-filled condition of said channels can be detected by detecting said discharge; said mass rate of liquid introduction being substantially equal to the sum of the mass rate of excess liquid discharge plus the mass rate of vaporized coolant removal.

13. The method of claim 12 wherein a small head of liquid coolant is developed in said path within the bucket adjacent said tip region such that leakage of vaporized coolant along said path is substantially prevented.

* * * * *